United States Patent [19]

Swartwout

[11] 4,171,167

[45] Oct. 16, 1979

[54] TYPE HEAD CLEANER

[75] Inventor: Everett W. Swartwout, Duxbury, Mass.

[73] Assignee: Vikor Company, Inc., Nashua, N.H.

[21] Appl. No.: 822,629

[22] Filed: Aug. 8, 1977

[51] Int. Cl.[2] ..... B41J 29/00

[52] U.S. Cl. ..... 400/702; 15/21 A

[58] Field of Search ..... 197/52, 184, 185; 15/21 A, 21 B, 38, 104.92, 160; 134/149; 400/702

[56] References Cited

U.S. PATENT DOCUMENTS

| | | | |
|---|---|---|---|
| 2,232,680 | 2/1941 | Foster | 400/702 |
| 2,926,768 | 3/1960 | Becker et al. | 197/52 |
| 3,307,677 | 3/1967 | Frank et al. | 197/52 |
| 3,583,016 | 6/1971 | McConnell | 15/21 A X |
| 3,740,784 | 6/1973 | Morrissey | 15/21 A |
| 3,748,676 | 7/1973 | Warren et al. | 15/21 A |
| 3,750,219 | 8/1973 | MacConnell | 15/21 A X |
| 3,806,983 | 4/1974 | Cunningham et al. | 15/21 A X |
| 4,017,933 | 4/1977 | Aja et al. | 197/184 X |

*Primary Examiner*—Ernest T. Wright, Jr.
*Attorney, Agent, or Firm*—Cesari & McKenna

[57] ABSTRACT

A cleaning device for a removable typewriter type head has an elongated stem with a platform thereon for snugly securing the type head to the stem. The stem terminates in a cover which is internally threaded for mating with a liquid container which carries a scouring element on the interior thereof through which the type head is moved when the cover is placed back on the container, together with a liquid type cleaner for dissolving ink and other accumulations on the type head.

10 Claims, 6 Drawing Figures

TYPE HEAD CLEANER

BACKGROUND OF THE INVENTION

A. Field of the Invention

The invention relates to type head cleaners and, more particularly, comprises a type head cleaner for removable typewriter type heads.

B. Prior Art

Typewriter type elements traditionally have been cleaned by liquid cleaners applied to the typeface by means of a sponge, a brush, a deformable putty-like carrier, etc. which works the liquid onto the type to thereby dissolve the accumulated ink which is thereafter removed. This method of cleaning is quite messy, and frequently exposes the user to noxious fumes during cleaning.

BRIEF DESCRIPTION OF THE INVENTION

A. Objects of the Invention

Accordingly, it is an object of the invention to provide an improved type head cleaner.

Further, it is an object of the invention to provide an improved type head cleaner for cleaning removable typewriter type heads.

Yet another object of the invention is to provide an improved type head cleaner that minimizes exposure of the user to cleaning fluids.

Another object of the invention is to provide an improved type head cleaner that is simple and easy to use, yet effective in operation.

B. Brief Description of the Invention

The present invention is particularly adapted to thoroughly cleaning removable type heads of the kind described in U.S. Pat. No. 3,307,677, issued Mar. 7, 1967 to Edgar H. Frank et al and assigned to the International Business Machines Corporation. This form of type head is commonly known as a "Selectric" type head and comprises a truncated spherical shell bearing the typeface on the outer surface thereof. The upper rim of the shell is serrated to mate with a carrier for moving the type head across the typewriter, while the lower portion of the shell terminates in a plateau having a central aperture therethrough and a pair of pins on either side of the aperture cammed to move inwardly and outwardly of the aperture, to enable mounting of the type head on the carrier.

For cleaning this type head, the present invention provides a container having a removable cover to which is secured a stem extending downwardly into the container when the cover is secured thereon. The stem has a platform adjacent a lower end thereof, and a pair of shoulders mounted on the underside of the platform and sized to fit the serrated notches on the type head. A groove extends around the lowermost end of the stem and accepts the pins of the type head. The type head is positioned on the stem and the pins are cammed inwardly by the camming mechanism. This clamps the type head securely to the stem, while the shoulders on the platform secure the type head against rotation with respect to the stem.

Fastened to the interior of the container is a scrubbing pad in the form of a plug conforming to the interior walls of the container and having a scalloped aperture through which the stem, together with the type head on it, is extended during removal or replacement of the stem in the container. A quantity of liquid solvent for attacking and loosening the ink on the type head is also placed in the container.

In use, the container cover (and thus the stem) is removed from the container such as by unscrewing it and the type head to be cleaned is fastened onto the stem and secured against rotation with respect to the stem by engaging the serrated upper edges of the type head with the shoulders on the platform of the stem. The cover is then re-applied to the container; as this is done, the type head is pushed with the stem through the scrubbing pad aperture and into the liquid solvent. When the cover is tightly secured, the container is rapidly shaken in order to remove the loosely-adherent ink accumulation on the type head face. Thereafter, the cover is again detached and is moved outwardly of the container a distance sufficient to bring the type head into contact with the scrubbing pad. When this is accomplished, the type head is rotated by the user against the scrubbing pad in order to clean and remove the more strongly adherent accumulations on the type face. The cover is then again lowered into the solvent to remove the loosened accumulations. Depending on the age and extent of the accumulations, the scrubbing and liquid dipping operations may be repeated several times before the head is satisfactorily cleaned. Periodically, the spent solvent liquid is replaced.

The device herein quickly and easily cleans the type head with a minimum of mess and exposure to possible harmful cleaning materials.

DETAILED DESCRIPTION OF THE INVENTION

The foregoing and other objects and features of the invention will be more readily understood on reference to the following detailed description of the invention, when taken in conjunction with the accompanying drawing, in which.

Figure 1:
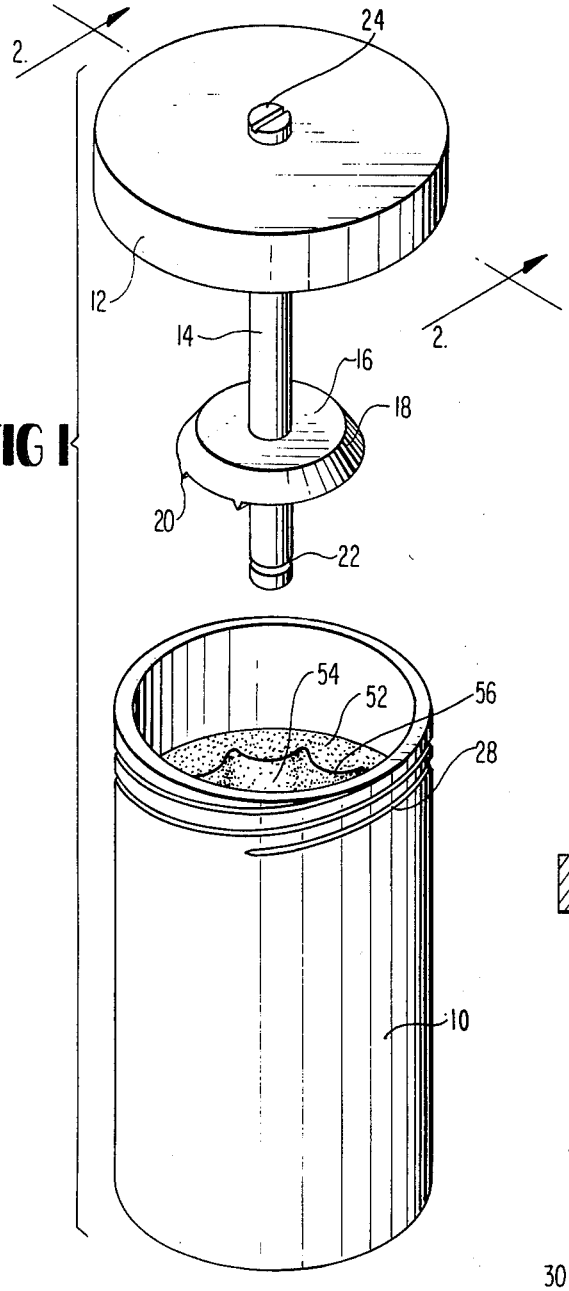
FIG. 1 is a pictorial view of the type head cleaner of the present invention depicting the cover and stem removed from the container.
Figure 2:
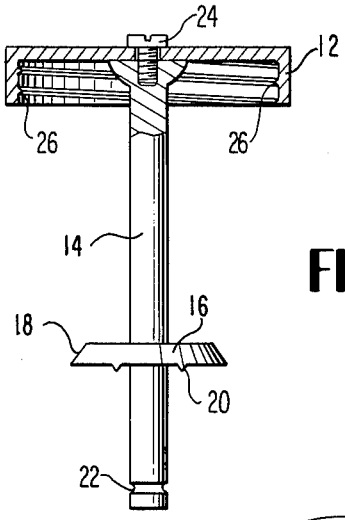
FIG. 2 is a cross section of the cover and stem of FIG. 1 along the lines 2—2 of FIG. 1.
Figure 3:
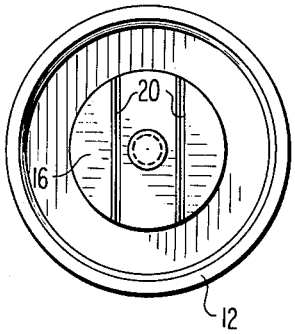
FIG. 3 is a bottom end view of the cover and stem of FIG. 2.

In FIG. 1, the type head cleaner of the present invention is shown as comprising a container 10, shown for purposes of illustration as a cylindrical canister, together with a cover 12 therefor having a downwardly extending stem 14. Positioned on the lower end of the stem 14 is a platform 16 having outwardly sloping sides 18 and shoulders 20. A groove 22 is formed at the lowermost end of the stem 14. The stem 14 is secured to the cover 12 by means of a screw 24, but other means of joining the two may be used, such as adhesives, heat-drying operations, etc. or the two may be molded as an integral unit. The cover 12 has an internal thread 26 which coperates with a corresponding groove 28 on the container 10 to facilitate liquid-tight attachment of the cover 12 to the container 10.

Figure 4:
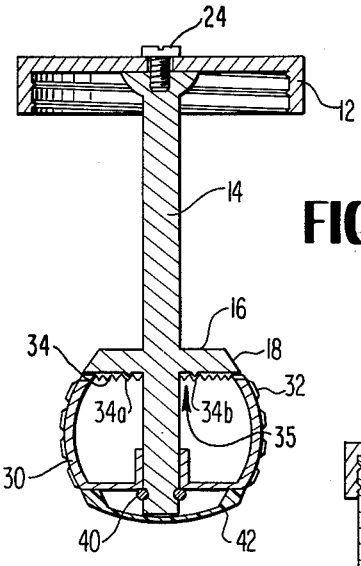
FIG. 4 is a cross sectional view of the cover and stem corresponding to FIG. 2 but showing a removable type head engaged thereon.
Figure 6:
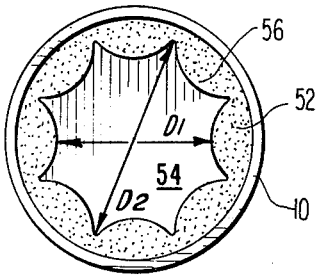
FIG. 6 is a top plan view of the container of FIG. 1 looking dowardly into the container and with the cover removed.

Turning now to FIG. 4, the manner in which the type head 30 is secured to the stem 14 is shown. A type head 30, comprising a truncated spherical segment having type 32 on an outer face thereof has a serrated circumferential surface 34 with an aperture 35 therein. The lower end of stem 14 is inserted through aperture 35 until serrated circumferential surface 34 butts against the platform 16 so that the shoulders 20 engage with a first and second pair of these notches 34*a* and 34*b*, respectively (only a single one of each pair of these notches 34*a* and 34*b* is shown in FIG. 4). Shoulders 20 are proportioned and spaced so as to snugly fit in the notches 34*a*, 34*b*. When the type head 30 is so seated against the platform 16, the groove 22 of the stem 14 is positioned opposite a pair of pins 40 which are mounted in a lower release unit 42 on the head 30. The pins 40 are held outwardly of the groove 22 by a cam (not shown) in the release unit 42 when the cam is positioned by the user in its "release" position and move inwardly into the groove 22 when the cam is moved to its "lock" position. In the latter position, the type head 30 is securely attached against removal from the stem 14. An example of a cam mechanism of the type referred to is provided, for example, in U.S. Pat. No. 3,307,677 to Frank et al.

Figure 5:
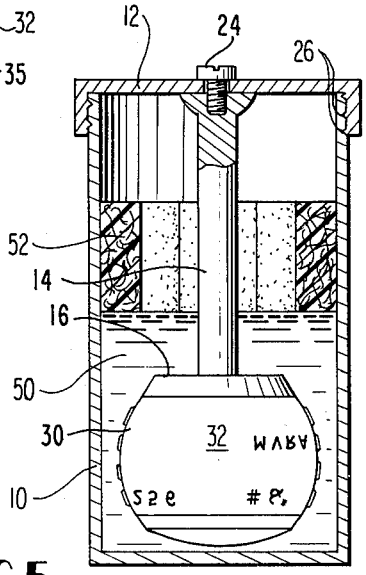
FIG. 5 is a cross sectional view of the container when the cover and stem carrying the type head are secured thereto.

Turning now to FIG. 5, the cover 12 is shown positioned securely on the container 10. In this position, the type head 30 rests slightly above the bottom of the container 10. Liquid solvent 50, surrounding the type head 30, facilitates the removal of ink and other accumulations on the type head face. Positioned above the type head 30 is a scrubbing pad 52 having a central aperture 54 defined by scalloped interior faces 56. The scrubbing pad 52 is in the form of a cylindrical plug whose outer surface conforms to the interior walls of the container 10. The minimum diameter $D_1$, of the aperture 54 is slightly larger than the maximum diameter of the platform 16 to facilitate passage of the platform 16 therethrough, but smaller than the maximum diameter of the type head 30. The diameter $D_2$ is somewhat larger than the diameter $D_1$ and defines a first passageway diameter for aperture 54 which is larger than the type head maximum diameter; this arrangement accomodates the displaced portions of the pad 52 when the type head 30 passes through it. Thus, as the type head 30 is moved through the aperture 54 of scrubbing pad 52, the pad 52 contacts the type 32 on the face of the type head 30, thereby scouring the accumulations therefrom. Advantageously, the pad 52 is of a deformable, resilient material to allow passage of the type head 30 through it while maintaining a scrubbing force on it, and is absorbent so that it holds solvent liquid therein. An excellent material for this purpose has been found to be material sold under the trademark "Scotch-Brite" by the Minnesota Mining and Manufacturing Company; this material may be described as a form of plastic "steel wool" in that it is formed of a network of randomly oriented interengaging fibers of a hard plastic material. The deformable nature of a scrubbing pad thus formed permits diameter $D_2$ to even be slightly larger than the maximum diameter of the type head 30.

SUMMARY

From the foregoing it will be seen that I have provided an improved type head cleaner. The cleaner is simple and easy to use and protects the user from messy solutions or noxious fumes from cleaning solvent. The device is inexpensive to construct, and simple to use. By allowing replenishment of the liquid solvent, it offers the user an extended cleaning lifetime.

I claim:

1. A cleaner for cleaning a removable typewriter type head of the kind having a generally spherical type surface and an aperture through a portion thereof, and locking means associated with said aperture for securing said head to a typewriter, said cleaner comprising
   - A. means forming a stem for extension through said aperture,
   - B. means associated with said stem for engagement with said type head to prevent rotation of said head about said stem when torque is applied thereto, said type head engagement means comprising means forming a platform on said stem and having at least one shoulder on said platform for engagement with said type head, and
   - C. a container for holding a cleaning liquid and having in the interior thereof a cleaning element defining a yieldable passageway providing snug passage to said head when said stem is passed therethrough.

2. A cleaner according to claim 1 which further includes means forming a groove in said stem for further engagement with said type head to secure said head to said stem.

3. A cleaner according to claim 2 in which said cleaning element comprises means forming a resilient scrubbing pad in the form of a plug secured to the interior of said container, said passageway being centrally formed in said plug and being sized to snugly contact said type head when said head is passed therethrough.

4. A cleaner according to claim 3 in which said passageway is defined by scalloped edges of said plug.

5. A cleaner according to claim 4 in which said cleaning element comprises a liquid absorbent scouring material.

6. A cleaner for cleaning a removable typewriter type head of the kind having a generally spherical type surface and, an aperture through a portion thereof for mounting said head on a typewriter, locking means associated with said aperture for securing said head to said typewriter, and a circumferentially extending serrated surface formed thereon, said cleaner comprising:
   - A. a liquid container having a yieldable cleaning element mounted on the interior thereof and defining, by means of a central aperture therethrough, a snug passageway for said type head, and
   - B. a liquid sealing cover for said container and having thereon a stem including thereon
     - (1) means forming a platform having at least one shoulder for engagement with said serrated surface of said type head to prevent rotation of said head with respect to said stem when torque is applied to said head, and
     - (2) locking means cooperating with said head to prevent inadvertent removal of said head from said stem.

7. A cleaner according to claim 6 in which said cleaning element comprises a plug fixedly mounted on the interior of said container, said aperture in said plug having scalloped edges defining a first passageway diameter larger than the maximum diameter of said type head.

8. A cleaner according to claim 7 in which said cleaning element comprises a resilient, liquid absorbent scouring pad mounted to scour said head as said head is passed therethrough.

9. A cleaner according to claim 8 which includes a liquid solvent in said container for removing unwanted accumulation from said type head.

10. A cleaner according to claim 9 in which said locking means cooperating with said head to prevent inadvertent removal of said head from said stem comprises means forming a groove around said stem at an end thereof and engaging said type head locking means therein to secure said head to said stem.

* * * * *